US008225880B2

(12) United States Patent
Rytlewski et al.

(10) Patent No.: US 8,225,880 B2
(45) Date of Patent: Jul. 24, 2012

(54) METHOD AND SYSTEM FOR ZONAL ISOLATION

(75) Inventors: Gary L. Rytlewski, League City, TX (US); John Whitsitt, Houston, TX (US); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 401 days.

(21) Appl. No.: 12/628,287

(22) Filed: Dec. 1, 2009

(65) Prior Publication Data

US 2010/0139929 A1 Jun. 10, 2010

Related U.S. Application Data

(60) Provisional application No. 61/119,229, filed on Dec. 2, 2008.

(51) Int. Cl.
*E21B 33/12* (2006.01)

(52) U.S. Cl. ..... 166/387; 166/179

(58) Field of Classification Search ..... 166/387, 166/179, 118
See application file for complete search history.

(56) References Cited

U.S. PATENT DOCUMENTS

| | | | | |
|---|---|---|---|---|
| 4,137,970 | A * | 2/1979 | Laflin et al. | 166/292 |
| 5,195,583 | A * | 3/1993 | Toon et al. | 166/187 |
| 6,173,788 | B1 | 1/2001 | Lembcke et al. | |
| 6,581,682 | B1 | 6/2003 | Parent et al. | |
| 6,848,505 | B2 | 2/2005 | Richard et al. | |
| 7,143,832 | B2 | 12/2006 | Freyer | |
| 7,228,915 | B2 | 6/2007 | Thomson | |
| 7,318,481 | B2 | 1/2008 | Richard | |
| 7,373,991 | B2 | 5/2008 | Vaidya et al. | |
| 7,387,158 | B2 | 6/2008 | Murray et al. | |
| 7,392,841 | B2 | 7/2008 | Murray | |
| 7,431,098 | B2 | 10/2008 | Ohmer et al. | |
| 7,637,320 | B2 | 12/2009 | Howard | |
| 7,665,537 | B2 | 2/2010 | Patel | |
| 7,708,073 | B2 | 5/2010 | Richard | |
| 2005/0110217 | A1 | 5/2005 | Wood et al. | |
| 2005/0199401 | A1 | 9/2005 | Patel et al. | |
| 2007/0012436 | A1 | 1/2007 | Freyer | |
| 2007/0125532 | A1 | 6/2007 | Murray et al. | |
| 2007/0163777 | A1 | 7/2007 | Murray et al. | |
| 2008/0011473 | A1 | 1/2008 | Wood et al. | |
| 2008/0017376 | A1 | 1/2008 | Badalamenti et al. | |
| 2008/0023193 | A1 | 1/2008 | O'Brien | |
| 2008/0042362 | A1 | 2/2008 | Wood | |
| 2008/0078561 | A1 | 4/2008 | Chalker et al. | |
| 2008/0110626 | A1* | 5/2008 | Allison et al. | 166/288 |
| 2008/0149351 | A1* | 6/2008 | Marya et al. | 166/387 |

(Continued)

FOREIGN PATENT DOCUMENTS

WO 2007150040 A1 12/2007

(Continued)

*Primary Examiner* — David Andrews
(74) *Attorney, Agent, or Firm* — Rodney Warfford; Tim Curington; Robb Edmonds

(57) ABSTRACT

Disclosed herein is a completion device for a wellbore, that includes at least an elastomer circumferentially disposed around a tubular, the elastomer having a main sealing segment and at least one activation segment axially extending from the main sealing segment at opposing ends, wherein each activation segment has an exposed end; and an impermeable membrane circumferentially encasing the elastomer and configured to prevent an influx of wellbore fluids into the elastomer except at the exposed ends.

22 Claims, 2 Drawing Sheets

U.S. PATENT DOCUMENTS

2008/0277109 A1 11/2008 Vaidya
2009/0205816 A1 8/2009 De et al.
2009/0205841 A1 8/2009 Kluge et al.
2009/0205842 A1 8/2009 Williamson et al.
2010/0051294 A1* 3/2010 Nutley et al. ..... 166/387

FOREIGN PATENT DOCUMENTS

WO 2008002850 A3 1/2008

* cited by examiner

METHOD AND SYSTEM FOR ZONAL ISOLATION

CROSS-REFERENCE TO RELATED APPLICATIONS

This application claims the benefit of U.S. Provisional Patent Application No. 61/119,229 filed on 2 Dec. 2008, and entitled "Method and System for Zonal Isolation," the contents of which are hereby incorporated by reference in their entirety.

BACKGROUND

Expandable, or swellable, packers are well known in the oil and gas industry and have been used for about a decade. These "swell" packers are typically used to block the flow of fluids through the annular space between the pipe and the wall of the adjacent wellbore or casing by sealing off the space between them. In operation, swell packers are controllably deployed to precise locations in the wellbore to provide basic functions, such as zonal isolation, casing protection, and flow control. Swell packers generally conform to the surface of the open hole and anchor the tool against differential pressure during operation. Such packers are especially well-suited for use in uncased holes or in old or pitted casing where slips would generally cause damage to or failure of the surrounding casing. Furthermore, swell packers can seal in larger holes or rough or irregularly shaped holes where compression type packers of the same nominal size would not otherwise seal. Due to their simplicity of actuation, swell packers are an attractive option for zonal isolation applications, employed in both cased-hole and open-hole applications.

Swell packers typically include a swellable elastomeric material, which expands upon contacting a selected wellbore fluid. The selected wellbore fluids may be water-based (including diluted acids and brines) or hydrocarbons or any other acceptable fluid. Generally, the greater the expansion of the swell packer, the faster the elastomeric material swells. Packers that swell prematurely, however, will engage the side of the wellbore before the wellbore completion is completely deployed into the well, thereby making impossible the safe delivery of the packer to the desired location. Such premature engagement can also cause the packer to shear, tear, or otherwise sustain damage, which may undermine the integrity of the sealing engagement between the completion device and the wellbore.

Since unforeseen delays may arise during wellbore completion operations, it is not always known exactly how long deployment of a swell packer will take. Thus, the swellable material can potentially be exposed to the wellbore fluid for an extended period of time, thereby causing premature swelling even in completion operations that include swell-delaying structures. Therefore, there remains a need for improved swellable packer elements that enable the effective use of swellable materials without premature activation.

SUMMARY

Disclosed herein is a completion device for a wellbore, that includes at least an elastomer circumferentially disposed around a tubular, the elastomer having a main sealing segment and at least one activation segment axially extending from the main sealing segment at opposing ends, wherein each activation segment has an exposed end; and an impermeable membrane circumferentially encasing the elastomer and configured to prevent an influx of wellbore fluids into the elastomer except at the exposed ends.

Also disclosed herein is method of deploying a completion device into a wellbore for zonal isolation, comprising: running the completion device into the wellbore, wherein the completion device comprises: an elastomer circumferentially disposed around a tubular, the elastomer having a main sealing segment and at least one activation segment axially extending a length from the main sealing segment at opposing ends, wherein each activation segment has an exposed end; an impermeable membrane circumferentially encasing the elastomer to prevent an influx of wellbore fluids into the elastomer except at the exposed ends of the at least one activation segment; and a protective exterior; swelling the elastomer by absorbing the wellbore fluids through the exposed ends, wherein swelling occurs axially along the length of the at least one activation segment toward the main sealing segment; expanding the impermeable membrane and protective exterior in response to the swelling; and swelling the main sealing segment by absorbing the wellbore fluids therein, wherein the main sealing segment is unswelled until the wellbore fluids have permeated the length of the at least one activation segment.

Also disclosed herein is a swell packer, comprising: a high-swell elastomer circumferentially disposed around a tubular, the elastomer having a main sealing segment with at least one activation segment axially extending a length from the main sealing segment, wherein the at least one activation segment has an exposed end and a radial cross-section smaller than a radial cross-section of the main sealing segment; an impermeable membrane circumferentially encasing the elastomer except at the exposed end, wherein the impermeable membrane is configured to prevent an influx of wellbore fluids into the elastomer when it is not swelled except at the exposed end; and a protective exterior configured to shield the impermeable membrane from wellbore damage as the completion device is being run into the wellbore, wherein the main sealing segment is unswelled until the wellbore fluids have permeated the length of the at least one activation segment.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1A:
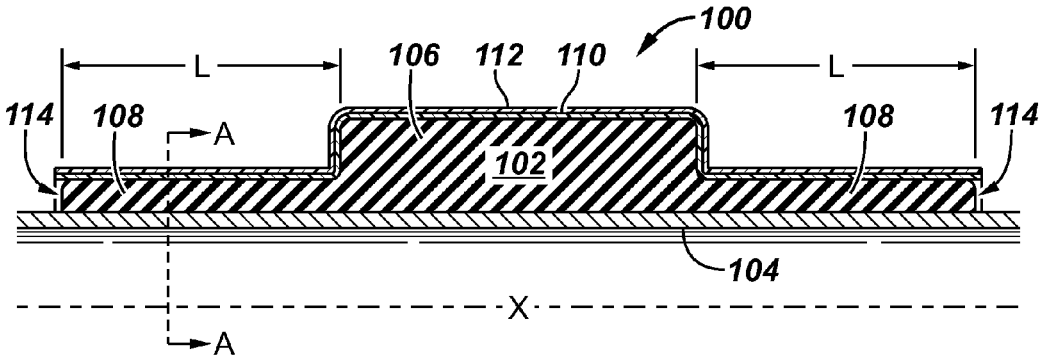
FIG. 1A depicts a simplified cross-sectional view of an exemplary completion device, in accordance with one or more embodiments described.
Figure 1B:
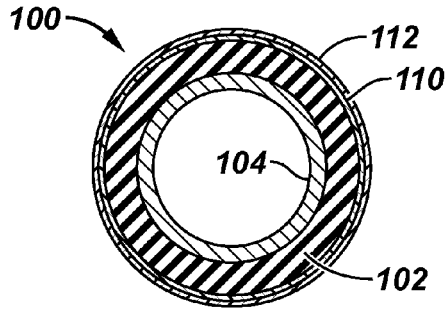
FIG. 1B depicts a cross-sectional view of the completion device of FIG. 1A, taken along the lines A-A in FIG. 1A.

Referring to FIGS. 1A and 1B, illustrated is an exemplary completion device 100, where FIG. 1B is a cross-sectional view taken along line A-A of FIG. 1A. In at least one embodiment, the completion device 100 can include a swell packer for use in isolating an annulus between a tubular 104, or tubing, and the side of a wellbore. In other exemplary embodiments, the completion device 100 can be employed in various other downhole tools and oil field elements without departing from the scope of this disclosure. Such tools and elements can include blow out preventers, submersible pump protectors, O-rings, gaskets, electrical insulators, pressure-sealing elements, etc. The tubular 104 can have a central longitudinal axis X and, although shown in a substantially horizontal disposition, the tubular 104 may also be disposed in a substantially vertical disposition, or any angular variation therebetween.

In one or more embodiments, the completion device 100 can include an elastomer 102 circumferentially disposed around the tubular 104. In one or more embodiments, the elastomer 102 can be bonded or otherwise attached to the tubular 104. In an exemplary embodiment, the elastomer 102 can be a high-swell elastomer configured to absorb or otherwise react to wellbore fluid, thereby expanding or swelling. In at least one embodiment, the elastomer 102 can include a swellable material, such as that described in U.S. Pat. No. 7,143,832, which is incorporated herein by reference in its entirety to the extent it is not inconsistent with this disclosure. It will be appreciated, however, that any wellbore-friendly swellable material can be used in accordance with this disclosure, as long as the swellable material includes a sufficient volumetric expansion potential to enable the completion device 100 to adequately seal the annulus between the tubular 104 and the wellbore.

Moreover, the elastomer 102 can include a main sealing segment 106 having delay sealing segments 108 axially extending therefrom to a length along the longitudinal axis X. In other embodiments not illustrated herein, the main sealing segment 106 can have a singular delay sealing segment 108 extending from one end of the main sealing segment. As illustrated, the radial cross-section of the main sealing segment 106 can be larger than the radial cross-section of the delay sealing segments 108. As will be described below in more detail, the high-swell elastomer 102 may only be exposed to wellbore fluids at the ends 114 of the delay sealing segments 108. Thus, the main sealing segment 106 will not begin to swell until the exposed ends 114 swell sufficiently to allow fluid to seep into the main sealing segment 106. Consequently, in one or more embodiments, the length of the delay sealing segments 108 can be adjusted or varied so as to delay the swelling activation of the main sealing segment 106. In other embodiments, however, the delay sealing segments 108 can be made of a different elastomeric material 102 than the main sealing segment 106.

In other embodiments not illustrated herein, the main sealing segment 106 can have a singular delay sealing segment 108 extending from one end of the main sealing segment.

In an exemplary embodiment, an impermeable membrane 110 can be circumferentially disposed around and directly adjacent the elastomer 102, excluding the exposed ends 114 where swelling of the elastomer 102 can commence. The impermeable membrane 110 can impermeably and sealingly encase the elastomer 102, such that substantially none of the wellbore fluid diffuses or leaks therethrough. In at least one embodiment, the impermeable membrane 110 can have sufficient toughness for wellbore handling and running in the hole, but can also be sufficiently brittle and weak to crack as the elastomer 102 underneath swells. Other embodiments can include a non-brittle impermeable membrane 110 that will instead plastically or elastically deform in response to the elastomer 102 swelling.

The impermeable membrane 110 can include materials such as, but not limited to, shrink tubing, polymer films, tapes made of polymer films, and/or metallic foils. In one or more embodiments, the shrink tubing and/or films can be stretched, applied, or otherwise wrapped as a coating over the elastomer 102. Tapes made of polymer films can be used to successively wrap the elastomer 102, where each successive wrapping of the tape can have about a 30% to about a 50% overlap.

In an exemplary embodiment, the impermeable membrane 110 can be made of polytetrafluoroethylene shrink tubing, although additional polymers can be used, including polymer films that are impermeable or "less" permeable to downhole fluids. For example, other exemplary polymers can include, without limitation, fluorinated ethylene propylene, ethylene tetrafluoroethylene, polyetheretherketone, acetal homopolymer and copolymer, liquid crystal polymers (such as VECTRA®), thermoplastic polyurethane (such as CELSTRAN®), Nylon 6-6, Nylon 12, polyphenylene sulfide, polybutylene terephthalate, polyvinyl chloride, polyesters (such as MYLAR®), polyvinyl fluoride, polyacrylonitrile, polyethylene terephthalate, polyethylene naphthalate, polyimide, or perfluoroalkoxy. Examples of metallic foils can include aluminum, copper, or any other malleable metal adapted to create an impermeable coating.

Still referring to FIGS. 1A and 1B, the completion device 100 can further include a protective exterior 112 enclosing, or circumferentially encasing the impermeable membrane 110. In one or more embodiments, the protective exterior 112 can be adapted to shield the outer surface of the impermeable membrane 110 and elastomer 102 from damage (such as abrasion, wear, and gouging) while the completion device is being run in-hole. Excluding the exposed ends 114 of the delay sealing segments 108, the protective exterior 112 can surround the entirety of the impermeable membrane 110 such that largely no wellbore fluid will diffuse or leak therethrough. In at least one embodiment, the protective exterior 112 can be configured to resist chemical degradation (i.e., not dissolve, disintegrate, or otherwise have diminished integrity) while disposed in typical wellbore environments, such as, water, hydrocarbons, brine mixtures, dissolved carbon dioxide, aqueous hydrogen sulfide, or other acidic or basic activating agents. Thus, the completion device 100 can be usable in a variety of wellbore environments, without regard to wellbore fluid compositions or the addition of typical activating agents that might otherwise prematurely degrade the protective exterior 112.

Figure 2A:
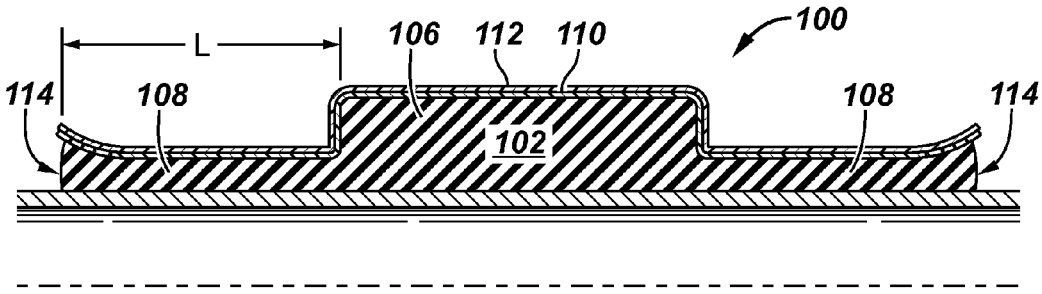
FIG. 2A depicts a cross-sectional view of the completion device at a stage of wellbore fluid permeation, in accordance with one or more embodiments described.

Referring now to FIGS. 2A-2D, illustrated is an exemplary embodiment of activating the completion device 100 in a wellbore, according to the present disclosure. Referring first to FIG. 2A, upon encountering wellbore fluids in a wellbore, the protective exterior 112 and impermeable membrane 110 can function substantially as described above, whereby the wellbore fluids are largely prevented from penetrating into the main sealing segment 106 of the elastomer 102. However, wellbore fluids can be absorbed into the elastomer 102 at the exposed ends 114, causing the exposed ends 114 to begin to swell axially along the length L of the delay sealing segments 108 in the direction of the main sealing segment 106. In an exemplary embodiment, the main sealing segment 106 does not begin to swell until the exposed ends 114 swell sufficiently to allow fluid to begin to penetrate into the area housing the main sealing segment 106. As can be appreciated, this reduces the potential of wear or damage to the main sealing segment 106 during wellbore insertion, and the pre-mature deployment of the completion device 100.

In at least one embodiment, swelling of the elastomer 102 can result in the expansion and/or cracking of a brittle impermeable membrane 110, while the protective exterior 112 may undergo an elastic and/or plastic deformation. As can be appreciated, cracking of the impermeable membrane 110 can provide several entry points for wellbore fluids to permeate the elastomer 102 along the length L of the delay sealing segments 108. Accordingly, the addition of more entry points into the elastomer 102 can accelerate the swelling process of the remaining elastomer 102. Nevertheless, one or more embodiments can include a non-brittle impermeable membrane 110 that fails to crack, whereby the elastomer 102 swell rate will be slower than an embodiment employing a brittle impermeable membrane 110.

Figure 2B:
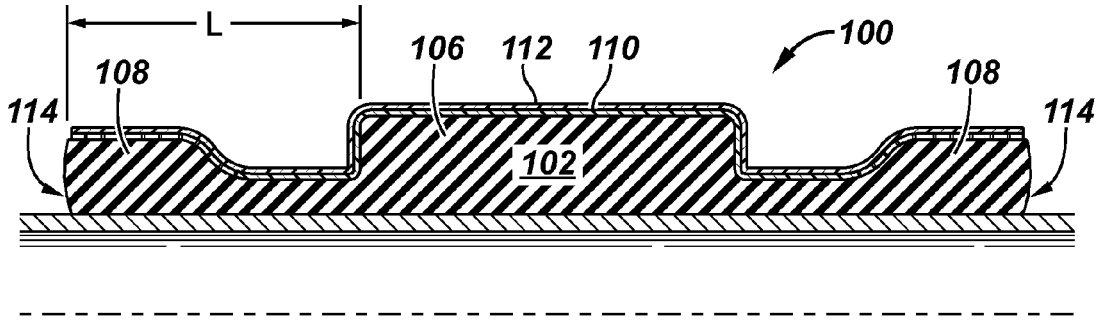
FIG. 2B depicts a cross-sectional view of the completion device at another stage of wellbore fluid permeation, in accordance with one or more embodiments described.

Referring now to FIG. 2B, as the exposed elastomer 102 along the length L of the delay sealing segments 108 continues to expand axially in the direction of the main sealing segment 106, the impermeable membrane 110 also continues to crack under the pressure, thereby allowing additional wellbore fluids to permeate the remaining elastomer 102. At the same time, the protective exterior 112 can be elastically/plastically deformed while nonetheless maintaining its structural integrity.

Figure 2C:
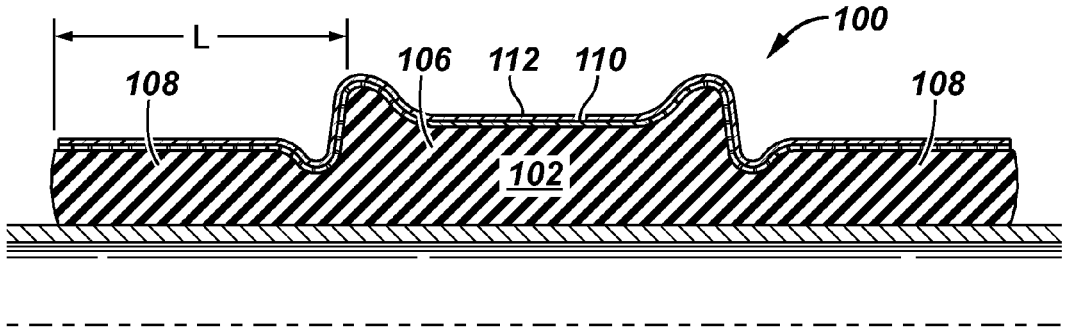
FIG. 2C depicts a cross-sectional view of the completion device at a further stage of wellbore fluid permeation, in accordance with one or more embodiments described.
Figure 2D:
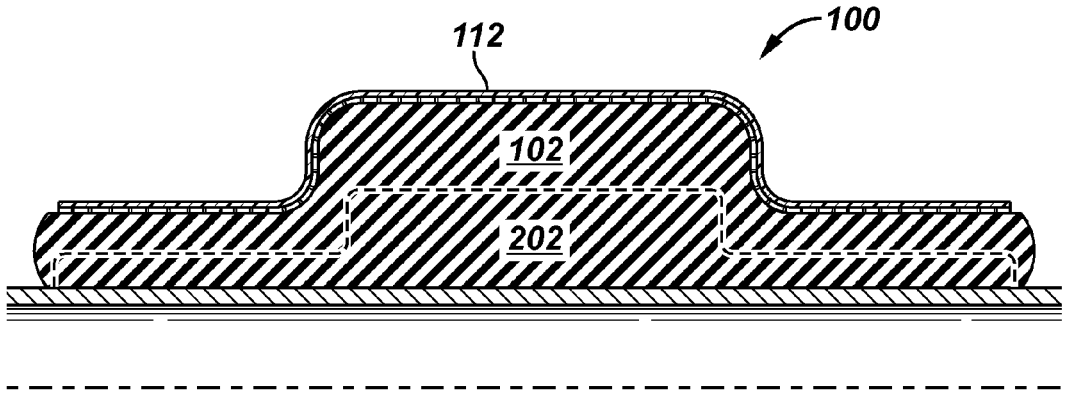
FIG. 2D depicts a cross-sectional view of the completion device at its swelled disposition, in accordance with one or more embodiments described.

FIG. 2C illustrates a point where the wellbore fluids have successfully permeated the whole length L of the delay sealing segments 108 and have begun to infuse into the main sealing segment 106. As the exposed elastomer 102 continues to swell, now swelling into the main sealing segment 106, the impermeable membrane 110 that covers the main sealing segment 106 likewise begins to expand and/or crack. Once the main sealing segment 106 begins to swell, the completion device 100 can begin to radially swell to its fully-activated posture. FIG. 2D illustrates the exemplary completion device 100 as fully activated, where the elastomer 102 has swelled to its full diameter within the wellbore. As illustrated, the protective exterior 112 can remain intact throughout the swelling process, thereby protecting the integrity of the elastomer 102 and supporting a more rigid seal. For comparative reasons, also illustrated in FIG. 2D is the original size of the elastomer 202 before swelling (shown in dotted lines).

As can be appreciated from the foregoing FIGS. 2A-2D, altering the length L of the delay sealing segments 108 will proportionately alter the time required to infuse wellbore fluids into the main sealing segment 106. More particularly, the time delay needed to reach a specific wellbore depth where the completion device 100 is to be fully activated can be primarily a function of the permeability rate through the exposed ends 114 of the elastomer 102 and the length L of the delay sealing segments 108. To determine the elastomer 102 permeability rate, simple tests can be carried out via coupons using specific well fluids at varying temperatures, and taking into account other wellbore influencing conditions. Once an accurate permeability rate is known, an operator will be able to determine an appropriate length L of the delay sealing segments 108 to allow the completion device 100 to reach the desired installation point before the main sealing segment 106 begins to swell. This will allow a standard-sized swell packer to be sold and operators in the field will only need to trim off a portion of the length L to adjust the time delay as needed.

Consequently, the embodiments disclosed herein can employ high-swell elastomers for zonal isolation because the time delay can be controlled independently by the length L of the delay sealing segments 108. This allows freedom to optimize the downhole chemistry for maximum swell and strength, greatly simplifying the product development time and time to customize swell packers to specific oil/gas fields.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A completion device for a wellbore, comprising:

an elastomer circumferentially disposed around a tubular, the elastomer having a main sealing segment and at least one activation segment axially extending from the main sealing segment at opposing ends, wherein each at least one activation segment has an exposed end; and an impermeable membrane circumferentially encasing the elastomer and configured to prevent an influx of wellbore fluids into the elastomer except at the exposed ends.

2. The completion device of claim 1 further comprising a protective exterior configured to shield the impermeable membrane from wellbore damage as the completion device is run into the wellbore.

3. The completion device of claim 2 wherein the protective exterior circumferentially encases as the impermeable membrane.

4. The completion device of claim 2, wherein the protective exterior is resistive to chemical degradation by wellbore environments.

5. The completion device of claim 1, wherein the elastomer is a high-swell elastomer.

6. The completion device of claim 1, wherein a radial cross-section of the main sealing segment is larger than a radial cross-section of the at least one activation segment.

7. The completion device of claim 1, wherein the impermeable membrane is brittle and configured to crack as the elastomer swells.

8. The completion device of claim 7, wherein the impermeable membrane comprises shrink tubing.

9. The completion device of claim 7, wherein the impermeable membrane comprises a polymer film.

10. The completion device of claim 7, wherein the impermeable membrane is made of a tape comprising shrink tubing or a polymer film and wrapped around the elastomer.

11. The completion device of claim 7, wherein the impermeable membrane is made of a metallic foil.

12. A method of deploying a completion device into a wellbore for zonal isolation, comprising:

running the completion device into the wellbore, wherein the completion device comprises:

an elastomer circumferentially disposed around a tubular, the elastomer having a main sealing segment and at least one activation segment axially extending a length from the main sealing segment at opposing ends, wherein each activation segment has an exposed end;

an impermeable membrane circumferentially encasing the elastomer to prevent an influx of wellbore fluids into the elastomer except at the exposed ends of the at least one activation segment; and a protective exterior;

swelling the elastomer by absorbing the wellbore fluids through the exposed ends, wherein swelling occurs axially along the length of the at least one activation segment toward the main sealing segment;

expanding the impermeable membrane and protective exterior in response to the swelling; and swelling the main sealing segment by absorbing the wellbore fluids therein, wherein the main sealing segment is unswelled until the wellbore fluids have permeated the length of the at least one activation segment.

13. The method of claim 12, wherein expanding the impermeable membrane comprises cracking the impermeable membrane to provide entry points for the wellbore fluids to permeate the elastomer along the length of the at least one activation segment.

14. The method of claim 12, wherein expanding the impermeable membrane comprises elastically or plastically deforming the impermeable membrane.

15. The method of claim 12, wherein expanding the protective exterior comprises plastically deforming the protective exterior.

16. The method of claim 12, wherein running the completion device into the wellbore is preceded by determining a permeability rate of the elastomer.

17. The method of claim 16, further comprising altering the length of the at least one activation segment to proportionately alter a delay period for the wellbore fluids to swell the main sealing segment.

18. A swell packer, comprising:

a high-swell elastomer circumferentially disposed around a tubular, the elastomer having a main sealing segment with at least one activation segment axially extending a length from the main sealing segment, wherein the at least one activation segment has an exposed end and a radial cross-section smaller than a radial cross-section of the main sealing segment;

an impermeable membrane circumferentially encasing the elastomer except at the exposed end, wherein the impermeable membrane is configured to prevent an influx of wellbore fluids into the elastomer when it is not swelled except at the exposed end; and a protective exterior configured to shield the impermeable membrane from wellbore damage as the completion device is being run into the wellbore, wherein the main sealing segment is unswelled until the wellbore fluids have permeated the length of the at least one activation segment.

19. The swell packer of claim 18, wherein the length of the main sealing segment is altered to delay the influx of the wellbore fluids into the main sealing segment.

20. The swell packer of claim 19, wherein the length of the main sealing segment is determined by a permeability rate of the high-swell elastomer.

21. The swell packer of claim 18, wherein the impermeable membrane is cracked in response to swelling of the elastomer.

22. The swell packer of claim 18, wherein the impermeable membrane is made of polytetrafluoroethylene shrink tubing.

* * * * *